US007146806B2

(12) United States Patent
Mavinahally

(10) Patent No.: US 7,146,806 B2
(45) Date of Patent: Dec. 12, 2006

(54) INTERNAL COMBUSTION ENGINE CYLINDER AND MUFFLER ASSEMBLY WITH CATALYTIC CONVERTER

(75) Inventor: Nagesh S. Mavinahally, Anderson, SC (US)

(73) Assignee: Homelite Technologies, Ltd., Hamilton (BM)

( * ) Notice: Subject to any disclaimer, the term of this patent is extended or adjusted under 35 U.S.C. 154(b) by 37 days.

(21) Appl. No.: 10/887,193

(22) Filed: Jul. 7, 2004

(65) Prior Publication Data

US 2006/0005794 A1 Jan. 12, 2006

(51) Int. Cl.
*F01N 3/10* (2006.01)

(52) U.S. Cl. ..... 60/302; 60/312; 60/314; 60/322; 60/323; 60/324; 123/65 PE; 123/65 A; 123/65 EM

(58) Field of Classification Search ..... 60/272, 60/274, 299, 302, 312, 313, 314, 322, 323, 60/324; 123/65 PE, 65 A, 65 EM, 65 P
See application file for complete search history.

(56) References Cited

U.S. PATENT DOCUMENTS

| | | | | |
|---|---|---|---|---|
| 3,240,194 A | | 3/1966 | Rychlik | 123/65 |
| 3,797,467 A | * | 3/1974 | Tenney | 123/73 AA |
| 3,810,361 A | | 5/1974 | Weaving et al. | 60/288 |
| 4,304,208 A | | 12/1981 | Etoh et al. | 123/568 |
| 4,862,689 A | | 9/1989 | Duret | 60/274 |
| 4,903,482 A | | 2/1990 | Overington et al. | 60/301 |
| 4,903,647 A | | 2/1990 | Yamamoto et al. | 123/65 PE |
| 4,911,115 A | | 3/1990 | Boyesen | 123/65 PE |
| 4,920,931 A | | 5/1990 | Klomp | 123/65 PE |
| 4,924,820 A | | 5/1990 | Lear et al. | 123/65 PE |
| 4,938,178 A | | 7/1990 | Schlunke et al. | 123/65 PE |
| 4,969,329 A | | 11/1990 | Bolton et al. | 60/288 |
| 4,969,330 A | * | 11/1990 | Groff et al. | 60/288 |
| 5,000,131 A | | 3/1991 | Masuda | 123/65 PE |
| 5,361,732 A | | 11/1994 | Kamata | 123/65 PE |
| 5,425,346 A | | 6/1995 | Mavinahally | 123/568 |
| 5,832,881 A | | 11/1998 | Karay et al. | 123/65 PE |
| RE37,230 E | * | 6/2001 | Schlunke et al. | 123/65 PE |
| 6,662,766 B1 | * | 12/2003 | Araki et al. | 123/73 PP |
| 2003/0173148 A1 | | 9/2003 | Andersson | |

FOREIGN PATENT DOCUMENTS

| | | |
|---|---|---|
| DE | 196 36 747 | 3/1998 |
| DE | 101 28 414 | 12/2001 |
| EP | 0 396 262 A2 | 11/1990 |
| GB | 2 280 711 A | 2/1995 |
| WO | WO 01/42633 | 6/2001 |

* cited by examiner

*Primary Examiner*—Binh Q. Tran
(74) *Attorney, Agent, or Firm*—Brinks Hofer Gilson & Lione

(57) ABSTRACT

A two cycle internal combustion engine cylinder having a piston chamber. The cylinder includes transfer ports; and an exhaust port divided into at least two sections. A first one of the sections has an aperture at the piston chamber with a top surface located closer to a top of the piston chamber than a top surface of an aperture of a second one of the sections at the piston chamber. The first section has a cross-sectional area which is smaller than a cross-sectional area of the second section. The aperture into the first section is located further away from the transfer ports than the aperture into the second section.

13 Claims, 5 Drawing Sheets

INTERNAL COMBUSTION ENGINE CYLINDER AND MUFFLER ASSEMBLY WITH CATALYTIC CONVERTER

BACKGROUND OF THE INVENTION

1. Field of the Invention

The present invention relates to an internal combustion engine and, more particularly, to an exhaust port from a cylinder.

2. Brief Description of Prior Developments

U.S. Pat. No. 5,425,346 discloses a reason for selective exhaust gas recirculation based on time resolved exhaust gas hydrocarbon (HC) concentration at the exhaust port. A fraction of the exhaust gas rich in HC is recirculated through the piston and cylinder ports. The objective is to minimize the raw fuel from exhausting into ambient air. Instead the exhaust gas at an appropriate time is trapped and recirculated into the transfer passage for acting as a buffer medium between the fresh charge and burnt gas during scavenging process.

U.S. Pat. No. 5,361,732 discloses upper exhaust ports which are connected to a catalytic converter. The lower exhaust ports have flow that does not go through the catalytic converter. The two flows mix at an exhaust pipe. U.S. Pat. Nos. 3,240,194 and 4,920,931 show series of exhaust ports. U.S. Pat. No. 4,903,482 has two catalysts for treating different contents of gases released (high $NO_x$ and fuel in purge gas, respectively).

There is a desire to provides a muffler system which uses a lower amount of catalytic material and, hence, lowers the cost of the catalytic muffler. There is also a desire to provide a muffler system which improves heat issues within a catalytic muffler.

SUMMARY OF THE INVENTION

In accordance with one aspect of the present invention, a two cycle internal combustion engine cylinder is provided having a piston chamber. The cylinder includes transfer ports; and an exhaust port divided into at least two sections. A first one of the sections has an aperture at the piston chamber with a top surface located closer to a top of the piston chamber than a top surface of an aperture of a second one of the sections at the piston chamber. The first section has a cross-sectional area which is smaller than a cross-sectional area of the second section. The aperture into the first section is located further away from the transfer ports than the aperture into the second section.

In accordance with another aspect of the present invention, a two cycle internal combustion engine is provided comprising a cylinder having a piston chamber, transfer ports, and an exhaust port divided into at least two sections; and a muffler connected to the cylinder. The muffler comprises at least two exhaust gas paths connected to respective ones of the exhaust port sections. A first one of the paths does not comprise a catalyst. A second one of the paths comprises a catalyst. The first section of the exhaust port has an aperture at the piston chamber with a top surface located closer to a top of the piston chamber than a top surface of an aperture of the second section of the exhaust port at the piston chamber. The first section has a cross-sectional area which is larger than a cross-sectional area of the second section. The aperture into the first section is located further away from the transfer ports than the aperture into the second section.

In accordance with another aspect of the present invention, a two cycle internal combustion engine cylinder is provided having a piston chamber. The cylinder comprises transfer ports; and an exhaust port divided into at least two sections. A first one of the sections has an aperture at the piston chamber with a top surface located closer to a top of the piston chamber than a top surface of an aperture of a second one of the sections at the piston chamber. The first section has a cross-sectional area which is smaller than a cross-sectional area of the second section. The aperture into the second section extends at least partially around at least one lateral side of the aperture into the first section.

In accordance with another aspect of the present invention, a two cycle internal combustion engine cylinder is provided having a piston chamber. The cylinder comprises transfer ports; and an exhaust port divided into at least two sections. A first one of the sections has an aperture at the piston chamber with a top surface located closer to a top of the piston chamber than a top surface of an aperture of a second one of the sections at the piston chamber. The first section and the second section are located laterally adjacent each other along a height of the apertures into the exhaust port.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
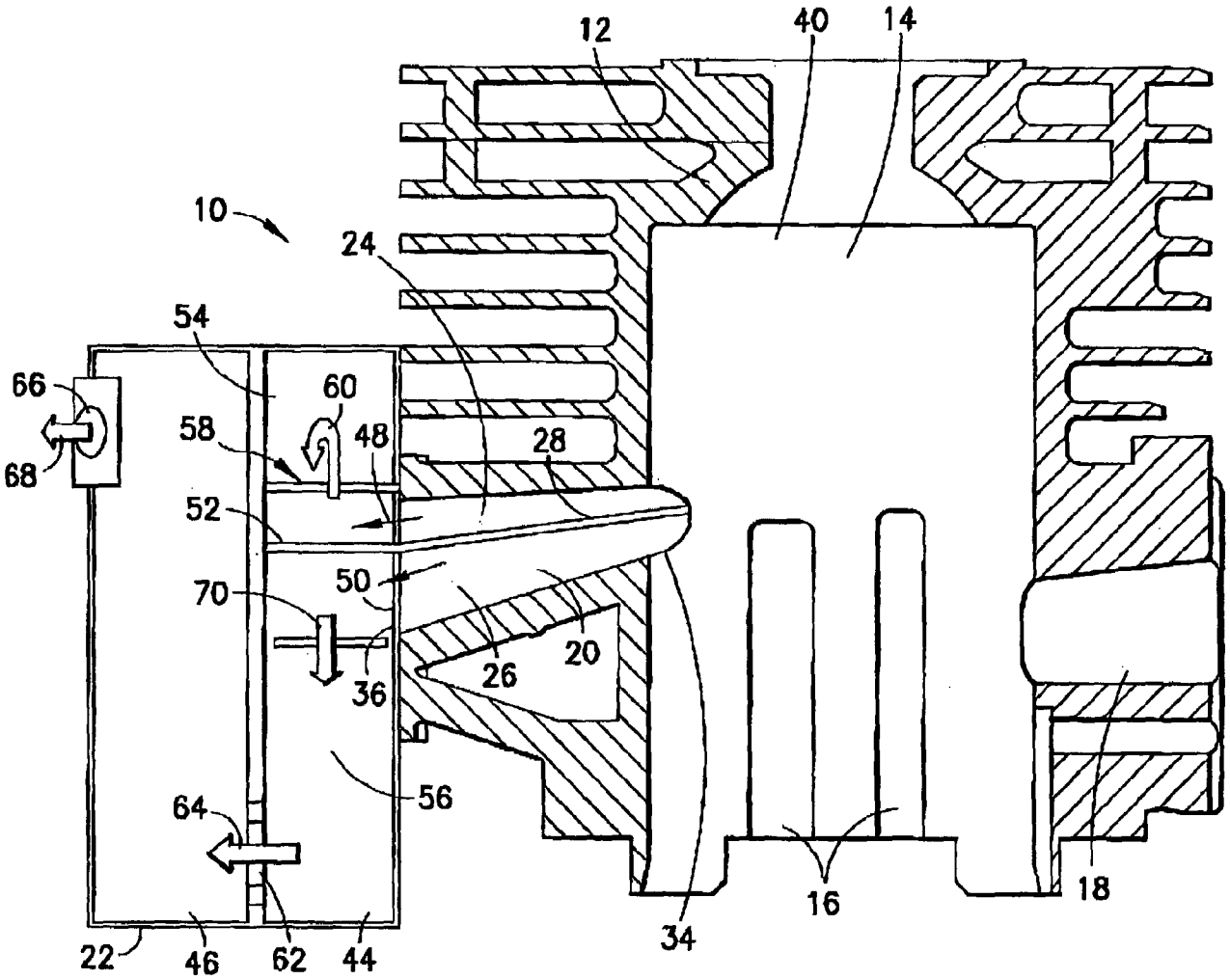
FIG. 1 is a schematic cross sectional view of an internal combustion engine and muffler incorporating features of the present invention.

Referring to FIG. 1, there is shown a schematic cross sectional view of an internal combustion engine 10 incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

The internal combustion engine 10 is preferably a two cycle internal combustion engine comprising a cylinder 12 having a piston chamber 14, transfer ports 16, inlet port 18, an exhaust port 20 and a muffler 22. Other conventional features of the engine, such as the piston, the crankcase, and the spark plug are not shown merely for the sake of simplicity.

Figure 2:
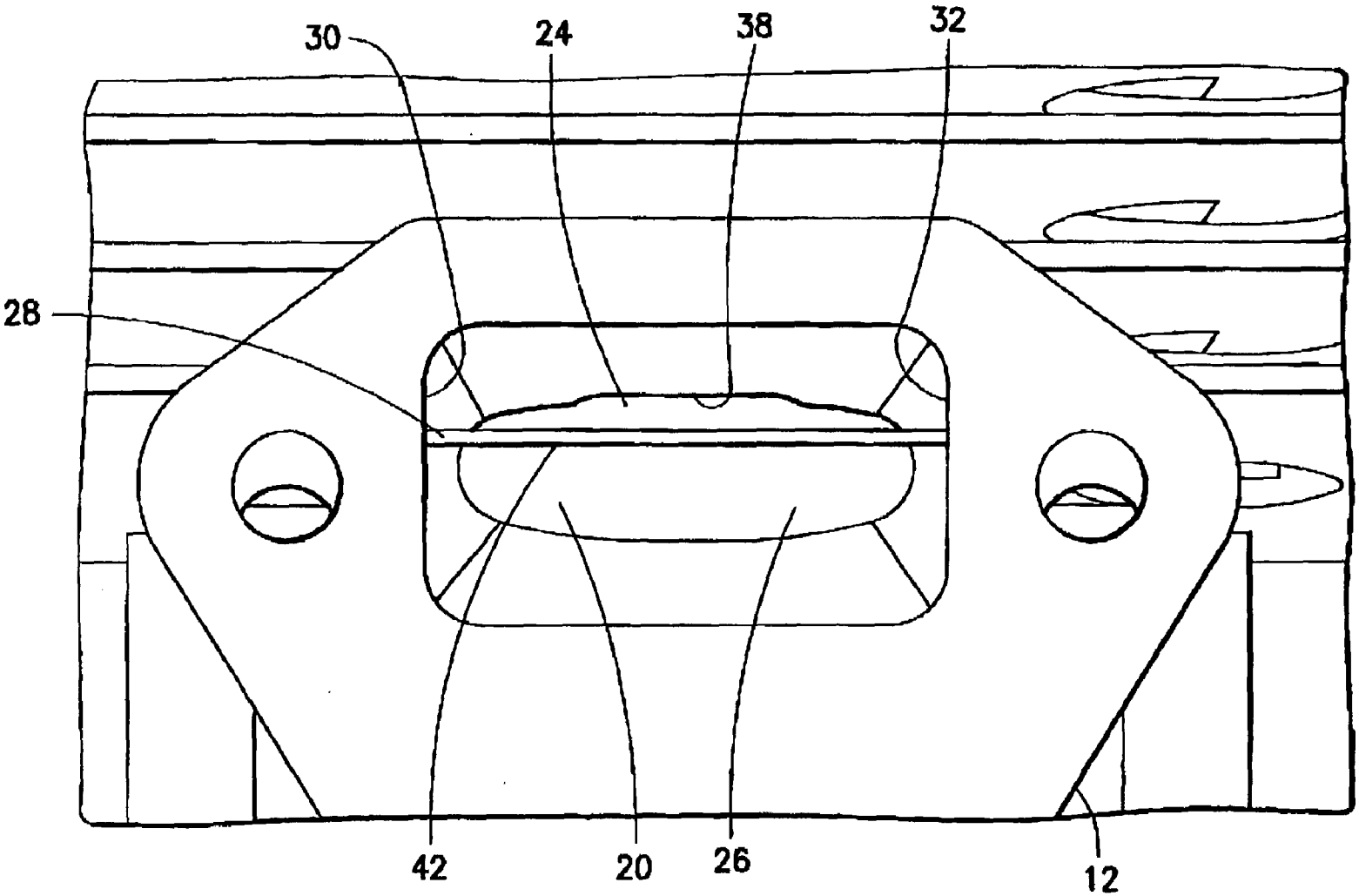
FIG. 2 is a side view of the cylinder of the engine shown in FIG. 1 at the outlet from the exhaust port.

Referring also to FIG. 2, a side view of the cylinder 12 at the exterior side of the exhaust port 20 is shown. The engine 10 also comprises a divider insert 28 located in the exhaust port 20. The exhaust port 20 is divided into a top section 24 and a bottom section 26 by the divider insert 28. The divider insert 28 is preferably comprised of a sheet metal member which is inserted into the exhaust port 20. However, in an alternate embodiment, any suitable type of material(s) could be used. In addition, the divider 28 could be machined or formed as an integral portion of the cylinder member 12. The divider insert 28 extends between two opposing sidewalls 30, 32 of the exhaust port 20 and extends from the front 34 of the exhaust port all the way to the rear 36 of the exhaust port at the exterior side of the cylinder member 12. The front of the divider insert 28 is preferably concave shaped to match the curved inner surface of the piston chamber 14.

The top section 24 of the exhaust port 20 has an aperture at the piston chamber 14 with a top surface 38 located closer to a top 40 of the piston chamber 14 than a top surface 42 of an aperture of the bottom section at the piston chamber. The top section 24 has a cross sectional area which is smaller than a cross sectional area of the bottom section 26. The aperture into the top section 24 is located further away from the transfer ports 16 than the aperture into the bottom section 26.

The muffler 22 comprises a first inner section 44 and a second outer section 46. The inner section 44 is mounted to the cylinder member 12 at the rear 36 of the exhaust port 20. An inlet into the inner section 44 comprises a top inlet section 48 and a bottom inlet section 50. The two inlet sections 48, 50 are separated from each other by a barrier section 52. This forms a top portion 54 and a bottom portion 56 in the inner section 44. The top portion 54 comprises a catalyst 58. As shown by arrow 60 exhaust gases passing into the top inlet section 48 pass through the catalyst 58 and then down towards the bottom portion 56 and through an aperture 62 as indicated by arrow 64 into the outer section 46, and subsequently out of the muffler at outlet 66 as indicated by arrow 68. The bottom portion 56 does not comprise a catalyst. Exhaust gases travel through the bottom section 26 of the exhaust port, through the bottom inlet section 50 and downward towards the aperture 62 as indicated by arrow 70. The two gas flows mix in bottom portion 56 and outer section 46 before the two gas flows exit from the muffler at outlet 66.

One of the unique features of this design lies in the ability to separate exhaust gas during the scavenging process based on crank angle port timing. Time resolved exhaust gas concentration has shown that hydrocarbon (HC) is highest at the exhaust port at a certain crank angle. It is believed that the concentration of short circuited charge is highest during the later part of the scavenging process (which is closer to piston closing the exhaust part). This means that the piston is ascending and the crank angle for optimum trapping of exhaust gas rich in HC would be around 20 to 30 degrees before the exhaust port is closed (or 10% to 25% of exhaust port area measured from top edge of the exhaust port).

In order to capture the exhaust gas in a narrow window of crank angle before the exhaust port is closed; the exhaust port is divided into two passages; upper and lower, as shown in FIGS. 1–2. In FIG. 1 the upper passage leads the exhaust gas into the exhaust chamber containing the catalytic converter for after treatment of exhaust gas rich in hydrocarbon (HC). The lower passage leads exhaust gas chamber where it mixes with treated gas which helps lower the exhaust gas temperature coming out of the converter. Thus, only a fraction of the exhaust gas needs to be passed through the catalytic converter, which helps minimize the amount of catalytic material needed to manufacture the muffler; thus lowering the cost of the converter muffler manufacture.

In U.S. Pat. No. 5,361,732 there are two top exhaust ports and a lower exhaust port. This means that there are a total of three exhaust ports. The biggest disadvantage is that the top exhaust ports are too close to the transfer ports and it is very likely that there will be more short circuit loss of fresh charge into the closest exhaust port either directly from transfer ports or from the cylinder during scavenging. Also, it appears that the total flow area from the two ports 25 is significantly larger, probably 75% to 80% of port 27, which may result in excessive blowdown and increase the exhaust sound. In the present invention, there are only two exhaust ports one on top of the other. The upper port is significantly smaller and is farther away from the transfer ports. In this embodiment the exhaust muffler also provides differential treatment of the exhaust gas.

Figure 3:
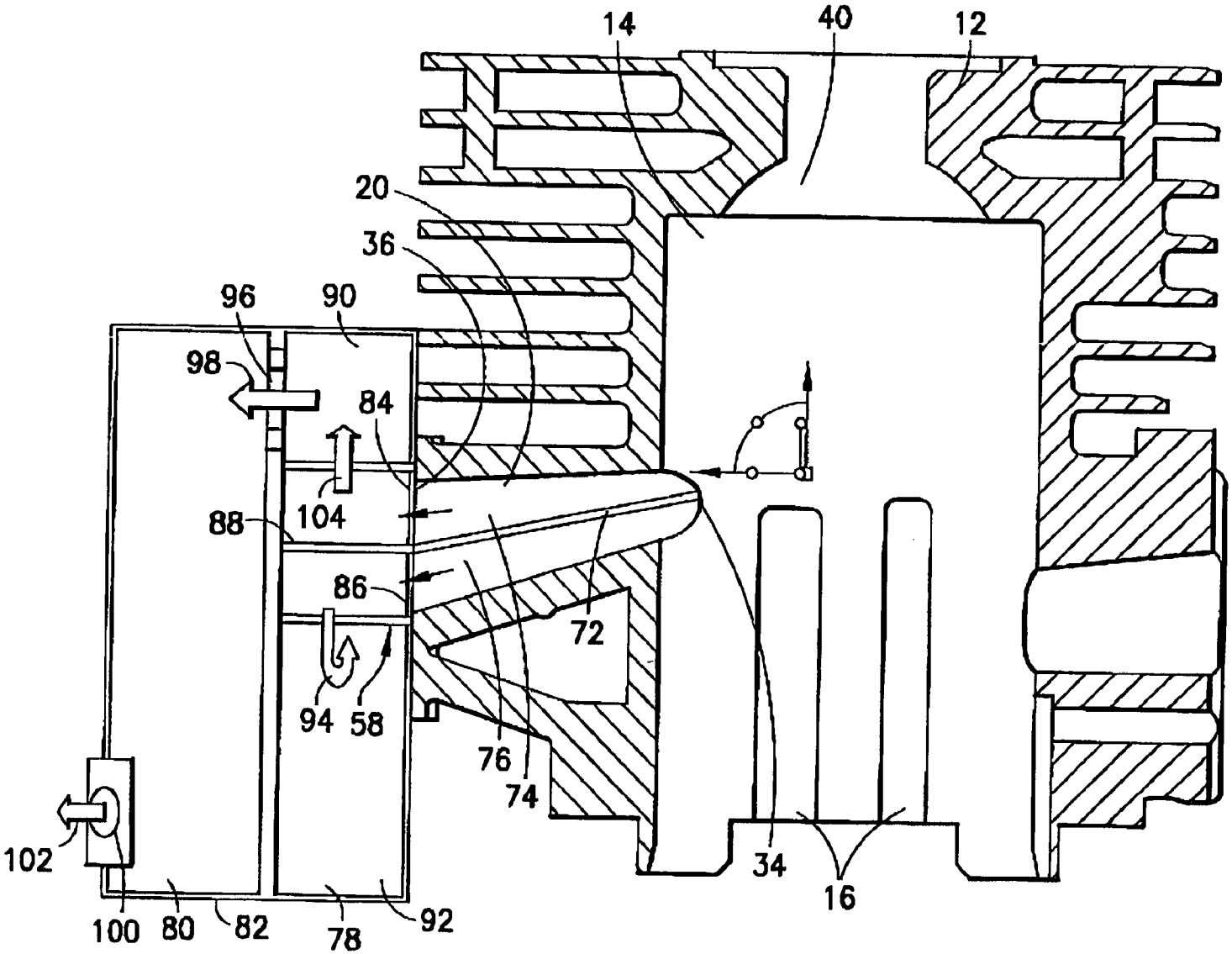
FIG. 3 is a schematic cross sectional view of an alternate embodiment of an internal combustion engine and muffler incorporating features of the present invention.

Some literature indicate that concentration of HC is highest around Bottom Dead Center (BDC). An alternative arrangement of passing the exhaust gas from lower passage into the catalytic converter is shown in FIG. 3. Referring now to FIG. 3, the size and shape of the cylinder member 12 is identical to the cylinder 12 shown in FIG. 1 with the exception of the shape and location of the divider insert. The divider insert 72 is located in a lower position inside the exhaust port 20.

The exhaust port 20 is divided into a top section 74 and a bottom section 76 by the divider insert 72. The divider insert 72 is preferably comprised of a sheet metal member which is inserted into the exhaust port 20. However, in an alternate embodiment, any suitable type of material(s) could be used. In addition, the divider 72 could be machined or formed as an integral portion of the cylinder member 12. The divider insert 72 extends between two opposing sidewalls of the exhaust port 20 and extends from the front 34 of the exhaust port all the way to the rear 36 of the exhaust port at the exterior side of the cylinder member 12. The front of the divider insert 72 is preferably concave shaped to match the curved inner surface of the piston chamber 14.

The top section 74 of the exhaust port 20 has an aperture at the piston chamber with a top surface located closer to a top 40 of the piston chamber 14 than a top surface of an aperture of the bottom section 76 at the piston chamber. The top section 74 has a cross sectional area which is larger than a cross sectional area of the bottom section 76. The aperture into the top section 74 is located further away from the transfer ports 16 than the aperture into the bottom section 76.

The muffler 82 comprises a first inner section 78 and a second outer section 80. The inner section 78 is mounted to the cylinder member 12 at the rear 36 of the exhaust port 20. An inlet into the inner section 78 comprises a top inlet section 84 and a bottom inlet section 86. The two inlet sections 84, 86 are separated from each other by a barrier section 88. This forms a top portion 90 and a bottom portion 92 in the inner section 78. The bottom portion 92 comprises a catalyst 58. As shown by arrow 94 exhaust gases passing into the bottom inlet section 86 pass through the catalyst 58 and then upwards towards the top portion 90 and through an aperture 96 as indicated by arrow 98 into the outer section 80 and subsequently out of the muffler at outlet 100 as indicated by arrow 102. The top portion 90 does not comprise a catalyst. Exhaust gases travel through the top section 74 of the exhaust port, through the top inlet section 84 and upwards towards the aperture 96 as indicated by arrow 104. The two gas flows mix in top portion 90 and outer section 80 before the two gas flows exit from the muffler at outlet 100.

Figure 4:
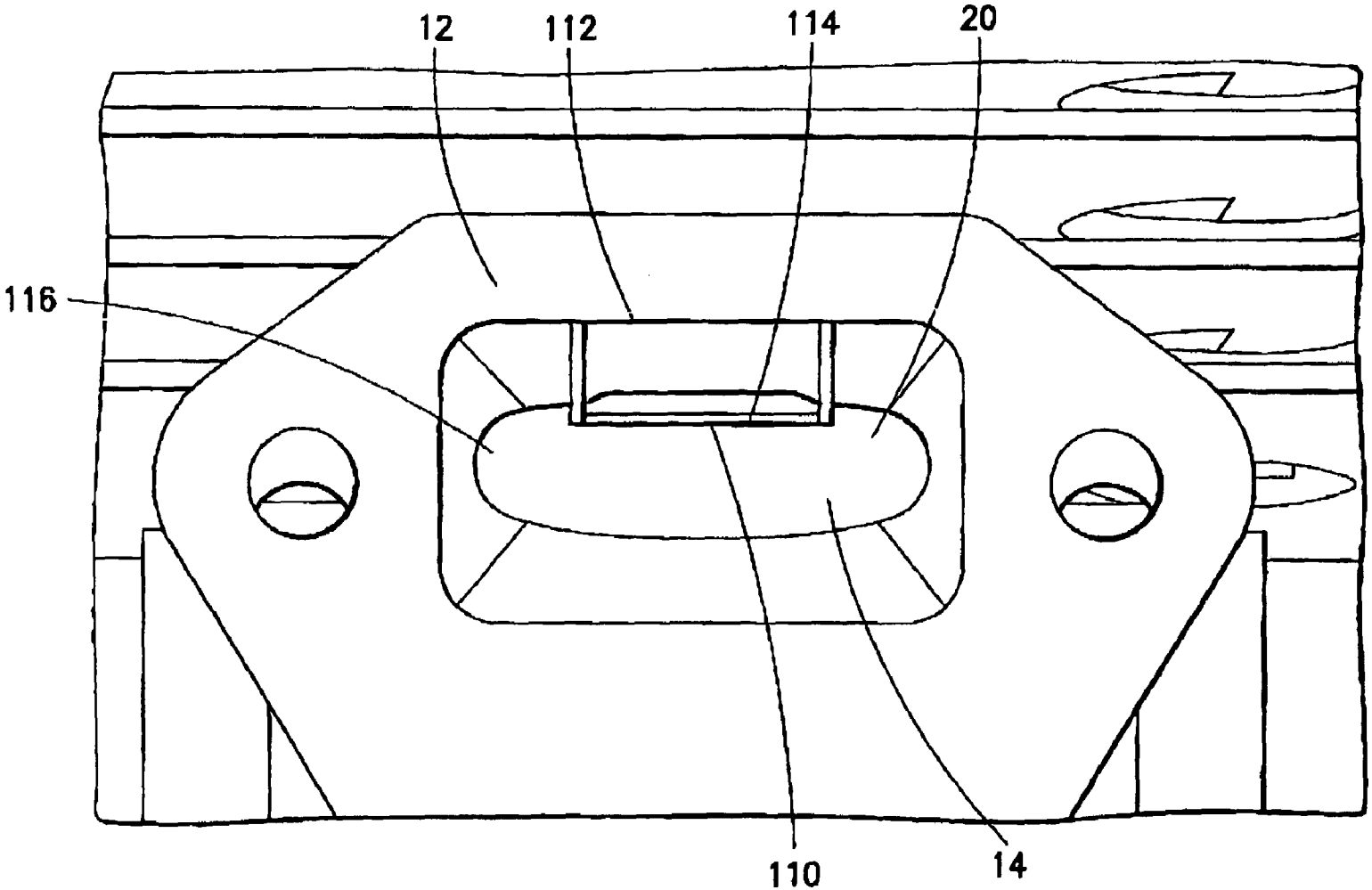
FIG. 4 is a side view at the outlet from the exhaust port of the cylinder having an alternate embodiment of a diverter insert incorporating features of the present invention.

Referring now to FIG. 4, another alternate embodiment of the present invention is shown. The size and shape of the cylinder member 12 is identical to the cylinder 12 shown in FIG. 1 with the exception of the shape and location of the divider insert. The diverter insert 110 comprises a general U-shaped cross-section. Top ends of the general U-shape diverter insert 110 is connected to the top surface 112 of the exhaust port 20. This forms a first section 114 of the exhaust port and a second section 116 of the exhaust port. The first section 114 has a cross sectional size which is smaller than the second section 116. The first section 114 has an aperture into the piston chamber 14 which is located further away from the transfer ports 16 than the second section 116. Because of the shape of the diverter insert 110, the second section 116 extends partially around the two lateral sides of the first section 114. The entrance into the muffler (not shown) would have a barrier which matched the cross sectional shape of the diverter insert 110. Thus, the muffler could treat gases passing through the first section 114 by means of a catalytic converter but not treat the gases flowing through the second section 116 with the catalytic converter.

Figure 5:
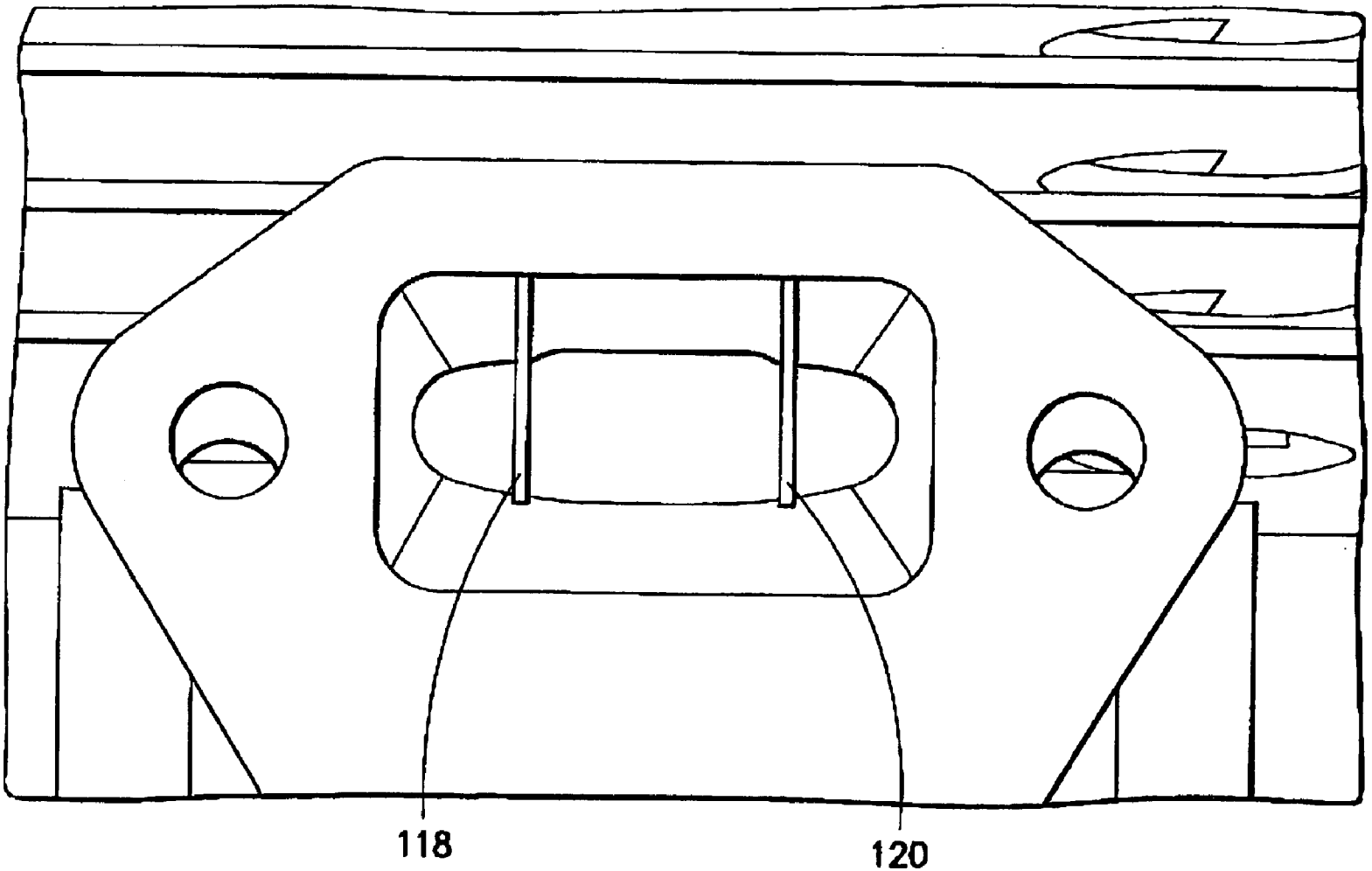
FIG. 5 is a side view at the outlet from the exhaust port of the cylinder having another alternate embodiment of multiple diverter inserts incorporating features of the present invention.

FIG. 5 shows double vertical ridges or diverter inserts 118, 120 that may help when a wider stepped exhaust port (such as the Chevron type exhaust port disclosed in U.S. patent application Ser. No. 10/452,079 filed May 30, 2003 which is hereby incorporated by reference in its entirety) is used. The ridge is generally used to prevent piston rings from catching in the port when wider ports are used. This arrangement may also provide an alternative method of getting smaller port area during early and late scavenging process to help improve trapping efficiency in a conventional engine. A non-catalytic muffler may also be used in conjunction with this type of exhaust port. The divided exhaust passage may be used for selective exhaust gas recirculation as described in U.S. Pat. No. 5,425,346 which is hereby incorporated by reference in its entirety.

The present invention provides an advantage by helping to lower the amount of catalytic material used in a converter muffler; hence lowering the cost of the catalytic muffler. Heat issues with catalytic mufflers may be better. As a smaller amount of exhaust gas is treated, the heat generated will also be less. Secondly, the divided chamber will help mix the gases well inside the muffler itself. Thus the exhaust gas temperature may be lower compared to a muffler with 100 percent of exhaust gas flowing through the catalytic converter. A double ridge exhaust can help widen the exhaust port when a chevron shape is used.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A two cycle internal combustion engine cylinder having a piston chamber comprising:

an inlet port;

transfer ports;

an exhaust port divided into at least two sections, wherein a first one of the sections has an aperture at the piston chamber with a top surface located closer to a top of the piston chamber than a top surface of an aperture of a second one of the sections at the piston chamber, wherein the first section has a cross-sectional area which is smaller than a cross-sectional area of the second section, and wherein the aperture into the first section is located further away from the transfer ports than the aperture into the second section; and a muffler connected to the cylinder, the muffler comprising at least two exhaust gas paths connected to respective ones of the exhaust port sections, a first one of the paths comprising a catalyst and a second one of the paths not comprising a catalyst, such that a portion of the exhaust flowing through the muffler does not flow past the catalyst.

2. A two cycle internal combustion engine as in claim 1 wherein the first path is connected to the first section of the exhaust port and the second path is connected to the second section of the exhaust port.

3. A two cycle internal combustion engine as in claim 2 wherein the catalyst is located in an upper part of the muffler.

4. A two cycle internal combustion engine as in claim 1 wherein the two paths mix before exiting the muffler.

5. A two cycle internal combustion engine cylinder as in claim 1 further comprising a divider insert located inside the exhaust port which divides the exhaust port into the at least two sections.

6. A two cycle internal combustion engine cylinder as in claim 5 wherein the divider insert extends between opposite lateral sides of the exhaust port.

7. A two cycle internal combustion engine cylinder as in claim 5 wherein the divider insert extends downward from a top surface of the exhaust port.

8. A two cycle internal combustion engine comprising:

a cylinder having a piston chamber, transfer ports, and an exhaust port divided into at least two sections; and a muffler connected to the cylinder, the muffler comprising at least two exhaust gas paths connected to respective ones of the exhaust port sections, a first one of the paths does not comprise a catalyst and a second one of the paths comprises a catalyst, such that a portion of exhaust flow from the cylinder does not flow past the catalyst, wherein the first section of the exhaust port has an aperture at the piston chamber with a top surface located closer to a top of the piston chamber than a top surface of an aperture of the second section of the exhaust port at the piston chamber, wherein the first section has a cross-sectional area which is larger than a cross-sectional area of the second section, and wherein the aperture into the first section is located further away from the transfer ports than the aperture into the second section.

9. A two cycle internal combustion engine as in claim 8 wherein the first path is connected to the first section of the exhaust port and the second path is connected to the second section of the exhaust port.

10. A two cycle internal combustion engine as in claim 9 wherein the catalyst is located in a lower part of the muffler.

11. A two cycle internal combustion engine as in claim 8 wherein the two paths mix before exiting the muffler.

12. A two cycle internal combustion engine as in claim 8 further comprising a divider insert located inside the exhaust port which divides the exhaust port into the at least two sections.

13. A two cycle internal combustion engine as in claim 12 wherein the divider insert extends between opposite lateral sides of the exhaust port.

* * * * *